US010109943B2

(12) United States Patent
Miyamura et al.

(10) Patent No.: US 10,109,943 B2
(45) Date of Patent: Oct. 23, 2018

(54) WIRE CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Yasuo Omori, Mie (JP)

(73) Assignees: Autonetworks Technologies, Ltd., Yokkaichi, Mie (JP); Sumitomo Wiring Systems, Ltd., Yokkaichi, Mie (JP); Sumitomo Electirc Industries, Ltd., Osaka-shi, Osaka (JP)

( * ) Notice: Subject to any disclaimer, the term of this patent is extended or adjusted under 35 U.S.C. 154(b) by 0 days.

(21) Appl. No.: 15/570,404

(22) PCT Filed: Apr. 18, 2016

(86) PCT No.: PCT/JP2016/062284
§ 371 (c)(1),
(2) Date: Oct. 30, 2017

(87) PCT Pub. No.: WO2016/181765
PCT Pub. Date: Nov. 17, 2016

(65) Prior Publication Data

US 2018/0145439 A1 May 24, 2018

(30) Foreign Application Priority Data

May 8, 2015 (JP) ..... 2015-095559

(51) Int. Cl.
*H01R 4/16* (2006.01)
*H01R 9/24* (2006.01)
(Continued)

(52) U.S. Cl.
CPC ..... *H01R 13/42* (2013.01); *H01R 4/16* (2013.01); *H01R 9/2416* (2013.01);
(Continued)

(58) Field of Classification Search
CPC .... H01R 13/42; H01R 13/506; H01R 13/514; H01R 13/631; H01R 4/16; H01R 9/2416; H01R 25/003
See application file for complete search history.

(56) References Cited

U.S. PATENT DOCUMENTS 4,797,119 A * 1/1989 Miyazawa ..... H01R 43/01 439/395
6,939,163 B2 * 9/2005 Fujita ..... H01R 13/4223 439/374
(Continued)

FOREIGN PATENT DOCUMENTS

JP 2008-053043 3/2008
JP 2011-223738 11/2011
(Continued)

OTHER PUBLICATIONS

International Search Report dated Jul. 5, 2016.

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

A connector includes wire-side terminals having the same shape and an insulation housing (30) for holding these terminals. The insulation housing (30) has terminal accommodating chambers (C11, . . . ), and terminal locking portions are provided in the respective terminal accommodating chambers (C11, . . . ). The terminal locking portions are classified into a first group that have a high holding force and a second group that have a low holding force. At least the terminal locking portions in the terminal accommodating
(Continued)

chambers (C11, C18, C31, C38) located on both outer sides in a maximum diameter direction belong to the first group and at least the terminal locking portions provided in the terminal accommodating chambers (C24, C25) closest to a center (O) of the array of the terminal accommodating chambers belong to the second group.

7 Claims, 2 Drawing Sheets

(51) Int. Cl.

| | |
|---|---|
| ***H01R 13/42*** | (2006.01) |
| ***H01R 13/506*** | (2006.01) |
| ***H01R 13/514*** | (2006.01) |
| ***H01R 13/631*** | (2006.01) |
| ***H01R 25/00*** | (2006.01) |
| *H01R 107/00* | (2006.01) |

(52) U.S. Cl.
CPC ..... *H01R 13/514* (2013.01); *H01R 13/631* (2013.01); *H01R 25/003* (2013.01); *H01R 13/506* (2013.01); *H01R 2107/00* (2013.01); *H01R 2201/26* (2013.01)

(56) References Cited

U.S. PATENT DOCUMENTS

| | | | | |
|---|---|---|---|---|
| 7,722,414 | B2 * | 5/2010 | Tanaka | H01R 13/4365 439/595 |
| 9,923,295 | B2 * | 3/2018 | Fujimura | H01R 13/42 |
| 2018/0131117 | A1 * | 5/2018 | Washio | H01R 13/42 |

FOREIGN PATENT DOCUMENTS

| | | |
|---|---|---|
| JP | 2011-238624 | 11/2011 |
| JP | 2014-49399 | 3/2014 |

* cited by examiner

WIRE CONNECTOR

BACKGROUND

Field of the Invention

The invention relates to a connector to be provided on ends of wires included in a wire bundle, such as a wiring harness of an automotive vehicle, for electrically connecting these wires with other wires, circuits and the like.

Description of the Related Art

A connector provided on ends of wires included in a wire bundle generally includes wire-side terminals to be mounted on the ends of the respective wires and an insulating housing for holding these wire-side terminals. This insulating housing defines terminal accommodating chambers for receiving the respective wire-side terminals inserted therein and includes terminal locking portions for respectively locking the wire-side terminals inserted into the terminal accommodating chambers. Each of the terminal locking portions has a locking lance with a base connected to a housing body of the insulating housing and a tip on a side opposite to the base. Each terminal locking portion allows the insertion of the wire-side terminal into the terminal accommodating chamber by being resiliently deformed and, on the other hand, engages the wire-side terminal by resiliently returning with the wire-side terminal completely inserted in the terminal accommodating chamber, thereby holding the wire-side terminal in the insulating housing.

However, this connector has a problem that the setting of a holding force of each terminal locking portion to hold the corresponding wire-side terminal is difficult. Specifically, if the holding force is low, the wire-side terminal cannot be held in the insulating housing against a large tensile load applied to the wire and there is a high possibility that the wire-side terminal is detached. Conversely, if the holding force is high, a resistance force, i.e. a so-called insertion force, generated when the wire-side terminal is inserted into the terminal accommodating chamber increases and the insertion is not easy. Particularly, wires have become thinner in recent years, and thinner wires buckle more easily when the wire-side terminal on the end of the wire is inserted into the terminal accommodating chamber while gripping the wire. Accordingly, an inserting operation becomes difficult.

An object of the invention is to provide a connector including wire-side terminals and an insulating housing that has terminal accommodating chambers for receiving the wire-side terminals inserted therein and capable of facilitating insertion of the wire-side terminals into the terminal accommodating chambers while satisfying holding forces to hold the wire-side terminals by the insulating housing.

To achieve the above object, the inventors focused on the detachment of the wire-side terminals from the insulating housing. Specifically, if a simple tensile load acts on the wire bundle, the tensile load is distributed uniformly to the wire-side terminals. Thus, the tensile load acting on one wire-side terminal is small. However, if a bending load acts on the wire bundle in a direction perpendicular to an axial direction of this wire bundle, a tensile load acts on the wires located outward of that bending curve and the wire-side terminals mounted on these wires in a biased manner. Thus, the wire-side terminals located outward of that bending curve tend to be detached earlier than the other wire-side terminals. On the other hand, the same holding force is set for the wire-side terminals having the same shape at present.

SUMMARY

The invention is directed to a connector for connecting wires to electrical connection targets thereof. The connector includes wire-side terminals to be mounted respectively on ends of the wires and having the same shape. The connector also includes an insulation housing for holding the wire-side terminals. The insulation housing has terminal accommodating chambers for receiving the respective wire-side terminals inserted therein and includes terminal locking portions for locking the wire-side terminals inserted into the respective terminal accommodating chambers. Each terminal locking portion allows the insertion of the wire-side terminal into the terminal accommodating chamber by being resiliently deformed and engages the wire-side terminal by resiliently returning when the wire-side terminal is inserted completely in the terminal accommodating chamber, thereby holding the wire-side terminal in the insulation housing. The terminal locking portions are classified into the terminal locking portions belonging to a first group and the terminal locking portions belonging to a second group with respect to a holding force of the terminal locking portion to hold the wire-side terminal. Each terminal locking portions belonging to the first group has a higher holding force than each terminal locking portion belonging to the second group. At least the terminal locking portions provided in the terminal accommodating chambers located on both outer sides in a maximum diameter direction belong to the first group and at least the terminal locking portion provided in the terminal accommodating chamber closest to a center of the array of terminal accommodating chambers belongs to the second group.

DETAILED DESCRIPTION

An embodiment of the present invention is described with reference to the drawings.

Figure 1:
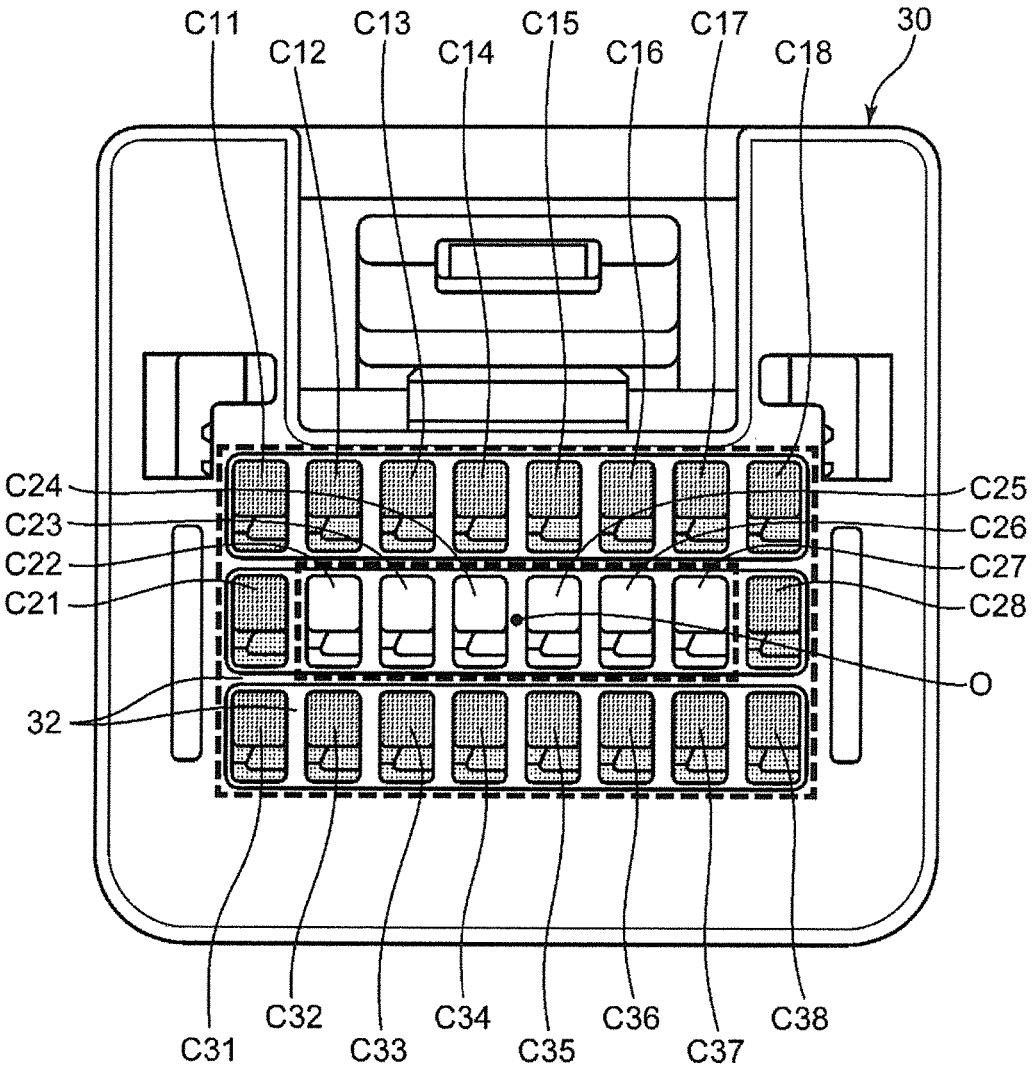
FIG. 1 is a front view of a connector according to an embodiment of the invention.
Figure 2:
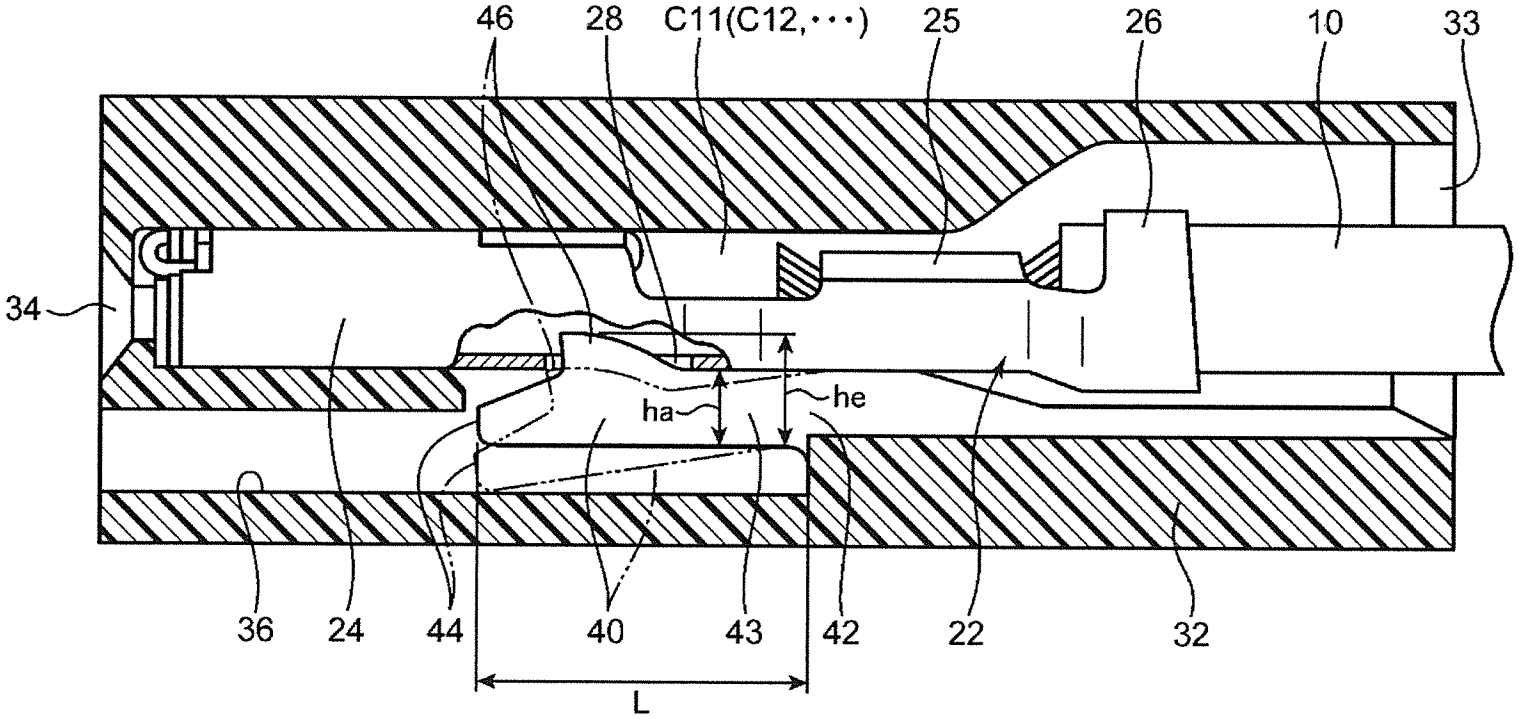
FIG. 2 is a side view in section showing the interior of a terminal accommodating chamber of the connector.

FIGS. 1 and 2 show a wire connector according to this embodiment. This connector is for connecting wires 10 included in a wire bundle to electrical connection targets thereof, and the electrical connection targets are not limited. The electrical connection targets include, for example, another wire bundle, a circuit board and a busbar for shorting the wires.

The connector includes wire-side terminals 20 shown in FIG. 2 and an insulating housing 30 for holding these wire-side terminals 20.

The wire-side terminals 20 are mounted respectively on ends of the wires 10. Each wire-side terminal 20 of this embodiment is a female terminal and includes a wire crimping portion 22 and an electrical contact portion 24 that are formed of a single metal plate.

The wire crimping portion 22 is a part to be crimped to the end of the wire 10 and includes a conductor barrel 25 and an insulation barrel 26. The conductor barrel 25 is crimped to a conductor part exposed at the end of the wire 10 to embrace the conductor part. The insulation barrel 26 is crimped to an insulation coating covering the conductor part behind a position where the conductor part is exposed and embraces the insulation coating. However, a specific mode of mounting the wire-side terminal on the wire is not limited in the invention.

The electrical contact portion 24 is configured to electrically contact the electrical connection target by being fit to a terminal included in the electrical connection target, i.e. to form electrical conduction. The electrical contact portion 24 according to this embodiment is of a female type and receives a mating male terminal fit therein. The wire-side terminal according to the invention is not limited to a female terminal and may be a male terminal.

The insulating housing 30 has the terminal accommodating chambers for receiving the respective wire-side terminals inserted therein, and the terminal accommodating chambers are arranged in horizontal and vertical directions to form a rectangular shape. Specifically, in an example shown in FIG. 1, eight terminal accommodating chambers are arranged in each of upper, middle and lower stages (a total of 24 terminal accommodating chambers). The terminal accommodating chambers C11, C12, C13, C14, C15, C16, C17 and C18 are arranged successively from the left in the first stage from top, the terminal accommodating chambers C21, C22, C23, C24, C25, C26, C27 and C28 are arranged successively from the left in the second stage, and the terminal accommodating chambers C31, C32, C33, C34, C35, C36, C37 and C38 are arranged successively from the left in the third stage.

Accordingly, with the wire-side terminals 20 inserted in the respective terminal accommodating chambers, a wire bundle composed of theaiy wires 10 connected to the respective wire-side terminals 20 has a cross-sectional shape corresponding to the array of the terminal accommodating chambers, i.e. a substantially rectangular cross-sectional shape in the example shown in FIG. 1.

FIG. 2 shows the terminal accommodating chamber C11 as a representative of the terminal accommodating chambers. The other terminal accommodating chambers have the same shape as the terminal accommodating chamber C11. Hence, the following description applies also to the other terminal accommodating chambers.

The insulating housing 30 includes separation walls 32 enclosing each terminal accommodating chamber. One end (right end in FIG. 2) of the terminal accommodating chamber C11 in an axial direction defines a terminal insertion opening 33 open in the axial direction, and the wire-side terminal 20 is inserted into the terminal accommodating chamber C11 through the terminal insertion opening 33. A male terminal insertion opening 34 is formed on a side opposite to the terminal insertion opening 33 and allows insertion of the male terminal to be fit into the electrical contact portion 24 of the wire-side terminal 20.

The insulating housing 30 further includes terminal locking portions for locking the wire-side terminals 20 inserted into the respective terminal accommodating chambers C11 (C12, . . . ). In this embodiment, each terminal locking portion has a locking lance 40 as shown in FIG. 2.

Each locking lance 40 is a cantilever that includes a base 42 connected to the separation wall 32 of the insulating housing 30, a tip 44 at an end opposite to the base 42, an arm 43 extending from the base 42 to the tip 44 and a locking projection 46. The arm 43 is resiliently deformable to deflect and displace the tip 44 down with the base 42 as a support. The locking projection 46 projects up from the arm 43 near the tip 44. On the other hand, a locking hole 28 is formed in a bottom wall of the wire-side terminal 20 and can receive the locking projection 46. Further, the separation wall 32 is formed with a retraction space 36 for receiving the locking lance 40 retracted to a retracted position.

The locking lance 40 moves from a locking position, shown by solid line in FIG. 2, to the retracted position, shown by chain double-dashed line in FIG. 2, by a deflection displacement of the tip 44, thereby allowing the wire-side terminal 20 to pass above the locking projection 46 and to be inserted completely into the terminal accommodating chamber C11. With the wire-side terminal 20 completely inserted in this way, the locking lance 40 can resiliently return to the locking position where the locking projection 46 thereof is fit into the locking hole 28 of the wire-side terminal 20 inserted into the terminal accommodating chamber C11, and locks the wire-side terminal 20, i.e. holds the wire-side terminal 20 in the terminal accommodating chamber C11 at this locking position.

The locking lances 40 have basically the same shape, but some locking lances 40 are slightly different in shape from the other locking lances 40 so that the some locking lances 40 have lower holding force and insertion force than the other locking lances 40. The holding force is a force of the locking lance 40 to hold the wire-side terminal 20 against a tensile force acting on the wire-side terminal 20 by the engagement of the locking projection 46 of the locking lance 40 and the wire-side terminal 20, and the insertion force is a force required to insert the wire-side terminal completely into the terminal accommodating chamber while deflecting the locking lance 40 to the retracted position. Thus, there is a correlation relationship between the holding force and the insertion force. A locking lance 60 with a higher holding force also has a higher insertion force of the wire-side terminal 20 into the terminal accommodating chamber.

The locking lances 40 are classified into the locking lances belonging to a first group and the locking lances belonging to a second group with respect to the holding force. The locking lances 40 belonging to the first group have a higher holding force than the locking lances 40 belonging to the second group. At least the locking lances 40 in the terminal accommodating chambers located on both outer sides in a maximum diameter direction belong to the first group, i.e. a group of the locking lances with a high holding force. Additionally, at least the locking lances 40 in the terminal accommodating chambers closest to a center O of the array of the terminal accommodating chambers belong to the second group, i.e. a group of the locking lances with a low holding force.

The maximum diameter direction means a direction of a straight line connecting the terminal accommodating chambers most distant from each other. Thus, if the terminal accommodating chambers are arrayed to have a rectangular shape, as shown in FIG. 1, directions along two diagonals of that rectangular shape are the "maximum diameter directions". Therefore, the terminal accommodating chambers located on both sides in the maximum diameter directions correspond to the terminal accommodating chambers C11, C18, C31 and C38 located on four corners of the rectangular shape.

On the other hand, the center O of the array of the terminal accommodating chambers corresponds to a center of a graphic specified by the terminal accommodating chambers. Thus, if the terminal accommodating chambers are arrayed to have a rectangular shape, as shown in FIG. 1, the center O corresponds to an intersection of the two diagonals of that rectangular shape. Therefore, the terminal accommodating chambers closest to the center O correspond to the terminal accommodating chambers C24, C25 in a middle of the second stage.

The holding forces and insertion forces of the locking lances 40 can be made different between the first and second groups by making the bending rigidity of the locking lances 40 and the positions of the locking projections 46 different. For example, the bending rigidity of the locking lance 40 can be increased to increase the holding force of the locking lance 40 and the insertion force corresponding thereto by increasing a height ha of the arm 43 of the locking lance 40 shown in FIG. 2 or reducing a length L of the arm 43 in the axial direction of the wire-side terminal 20. Further, the holding force of the locking lance 40 and the insertion force corresponding thereto can be increased by increasing a height he of the locking projection 46 of the locking lance 40, i.e. a distance between the separation wall 32 to the locking projection 46, that is, by inserting the locking projection 46 into the terminal accommodating chamber more.

As just described, the prevention of the detachment of the wire-side terminals 20 due to a bending load acting on the wire bundle and the facilitation of an operation of inserting the wire-side terminals 20 into the terminal accommodating chambers can be combined by making the holding forces of the respective locking lances 40 serving as the terminal locking portions for holding the wire-side terminals 20 different even though the wire-side terminals 20 have the same shape.

Specifically, at least the locking lances 40 for holding the wire-side terminals 20 mounted on the wires on both outer sides in the maximum diameter directions of the wire bundle, i.e. the locking lances 40 on which a largest tensile load possibly acts due to a bending load on the wire bundle (locking lances 40 in the terminal accommodating chambers C11, C18, C31 and C38 located on the four corners in FIG. 1), belong to the first group and have a high holding force. Thus, the wire-side terminals 20 can be held against a large tensile load resulting from the bending of the wire bundle in the maximum diameter directions.

On the other hand, the locking lances 40 in the terminal accommodating chambers closest to the center O corresponding to a bending center axis (locking lances C24, C25 in the center in FIG. 1) hardly are subjected to the tensile load resulting from bending and belong to the second group that have a holding force lower than the locking lances 40 belonging to the first group. Thus, the terminal accommodating chambers C24, 25 with the locking lances 40 belonging to the second group have low insertion forces and, accordingly, the inserting operation becomes easy.

The connector that obtains this effect is not limited to one in which the terminal accommodating chambers are arranged in the horizontal and vertical directions, as shown in FIG. 1. For example, a connector with terminal accommodating chambers arranged in a row may have the locking lances in the terminal accommodating chambers on both outer sides of the row belong to the first group and may have at least a locking lance in the terminal accommodating chamber in a center of the row belongs to the second group to obtain the above-described effect.

The locking lances belonging to the same group do not necessary have the same holding force and it is sufficient that at least the locking lances belonging to the first group have higher holding forces than those of the respective locking lances belonging to the second group. Further, the locking lances in the terminal accommodating chambers excluding the terminal accommodating chambers located on both outer sides in the maximum diameter directions (terminal accommodating chambers C11, C18, C31, C38 in the example shown in FIG. 1) and the terminal accommodating chambers closest to the center O (C24, C25 in the example shown in FIG. 1) may belong to either one of the first and second groups.

If the plurality of terminal accommodating chambers are arrayed to have a rectangular shape, for example, as shown in FIG. 1, the locking lances in all of the terminal accommodating chambers on both outer sides in a long side direction of that rectangular shape (on both left and right sides in FIG. 1, i.e. terminal accommodating chambers C11, C18, C21, C28, C31 and C38) preferably belong to the first group. This enables the detachment of the respective wire-side terminals 20 mounted on the wires located on both outer sides to be suppressed more reliably when a bending load acts on the wire bundle in the long side direction.

Further, if all the locking lances 40 in the terminal accommodating chambers located on an outermost periphery (colored terminal accommodating chambers C11 to C18, C21, C28, and C31 to C38 in the example shown in FIG. 1) belong to the first group, the wire-side terminals can be held against bending loads acting in all directions on the wire bundle. Further, if all of the locking lances in the terminal accommodating chambers inward of the terminal accommodating chambers on the outermost periphery (terminal accommodating chambers C22 to C27 in the example shown in FIG. 1) belong to the second group, the number of the terminal accommodating chambers into which the wire-side terminals 20 can be easily inserted can be increased.

As described above, a connector is provided with wire-side terminals and an insulation housing with terminal accommodating chambers for receiving the wire-side terminals inserted therein. The connector can facilitate an operation of inserting the wire-side terminals into the terminal accommodating chambers while satisfying holding forces to hold the wire-side terminals by the insulation housing.

The connector enables wires to be connected to electrical connection targets thereof and includes wire-side terminals to be mounted respectively on ends of the p wires and having the same shape, and an insulation housing for holding the wire-side terminals. The insulation housing defines terminal accommodating chambers for receiving the respective wire-side terminals inserted therein and includes terminal locking portions for locking the wire-side terminals inserted into the respective terminal accommodating chambers. Each terminal locking portion allows the insertion of the wire-side terminal into the terminal accommodating chamber by being resiliently deformed and engages the wire-side terminal by resiliently returning with the wire-side terminal completely inserted in the terminal accommodating chamber, thereby holding the wire-side terminal in the insulation housing. The terminal locking portions are classified into the terminal locking portions belonging to a first group and the terminal locking portions belonging to a second group with respect to a holding force of the terminal locking portion to hold the wire-side terminal. The terminal locking portions belonging to the first group have a higher holding force than each terminal locking portion belonging to the second group. At least the terminal locking portions in the terminal accommodating chambers located on both outer sides in a maximum diameter direction belong to the first group and at least the terminal locking portion provided in the terminal accommodating chamber closest to a center of the array of the terminal accommodating chambers belongs to the second group.

As just described, the prevention of the detachment of the wire-side terminals due to a bending load acting on a wire bundle and the facilitation of an operation of inserting the wire-side terminals into the terminal accommodating chambers can be combined by making the holding forces of the respective terminal locking portions for holding the wire-side terminals different even though the wire-side terminals have the same shape. Specifically, at least the terminal locking portions for holding the wire-side terminals mounted on the wires located on both outer sides in the maximum diameter direction of the wire bundle, i.e. the terminal locking portions corresponding to the wires on which a largest tensile load possibly acts due to the action of a bending load on the wire bundle, belong to the first group and have a high holding force. Thus, the wire-side terminals can be held against the large tensile load. On the other hand, at least the terminal locking portion in the terminal accommodating chamber closest to the center of the array of the terminal accommodating chambers and corresponding to the wire on which a small tensile load acts due to the bending of the wire bundle belongs to the second group and has a holding force lower than the terminal locking portions belonging to the first group. Thus, an insertion force of the wire-side terminal into the terminal accommodating chamber corresponding to the terminal locking portion belonging to the second group is low and, accordingly, the inserting operation becomes easy.

Note that the maximum diameter direction means a direction connecting the terminal accommodating chambers located at most distant positions out of the terminal accommodating chambers, and is not intended to limit that the array of the terminal accommodating chambers is circular. For example, if the terminal accommodating chambers are arrayed to have a rectangular shape (i.e. in horizontal and vertical directions), directions of diagonals of that rectangular shape correspond to the maximum diameter directions. Thus, the terminal accommodating chambers on four corners of this rectangular shape correspond to the "terminal accommodating chambers located on the both outer sides in the maximum diameter direction"

As just described, if the terminal accommodating chambers are arrayed to have a rectangular shape, the locking lances in all of the terminal accommodating chambers on both outer sides in a long side direction of that rectangular shape preferably belong to the first group. This enables the detachment of the respective wire-side terminals mounted on the wires located on the outer sides to be suppressed more reliably when a bending load acts on the wire bundle in the long side direction.

Further, if all of the terminal locking portions in the terminal accommodating chambers located on an outermost periphery belong to the first group, the wire-side terminals can be held against bending loads acting in all directions on the wire bundle. Further, if all of the terminal locking portions in the terminal accommodating chambers inwardly of the terminal accommodating chambers on the outermost periphery belong to the second group, the number of the terminal accommodating chambers into which the wire-side terminals can be easily inserted can be increased.

Preferably, each terminal locking portion is a locking lance including a base connected to a housing body of the insulation housing and a tip on a side opposite to the base, and resiliently deformed to deflect and displace the tip in a direction perpendicular to an axial direction of the wire-side terminal, and the locking lance includes a locking portion for engaging and locking the wire-side terminal near the tip. The locking lance allows the insertion of the wire-side terminal into the terminal accommodating chamber by being deflected and displaced and engages the wire-side terminal by resiliently returning with the wire-side terminal completely inserted in the terminal accommodating chamber, thereby holding the wire-side terminal in the insulation housing.

If the terminal locking portion is such a locking lance, the holding force of each locking lance can be made different by making the bending rigidity of the locking lance and the height of the locking portion different by the shape of the locking lance. Specifically, preferably, the locking lances belonging to the first group have a higher bending rigidity than the locking lances belonging to the second group or the locking portions of the locking lances belonging to the first group are inserted more into the terminal accommodating chambers than the locking portions of the locking lances belonging to the second group.

The invention claimed is:

1. A connector for connecting wires to electrical connection targets thereof, comprising:

wire-side terminals to be mounted respectively on ends of the wires and having the same shape; and an insulation housing for holding the wire-side terminals; wherein:

the insulation housing defines terminal accommodating chambers for receiving the respective wire-side terminals inserted therein and includes terminal locking portions for locking the wire-side terminals inserted into the respective terminal accommodating chambers;

each terminal locking portion allows the insertion of the wire-side terminal into the terminal accommodating chamber by being resiliently deformed and engages the wire-side terminal by resiliently returning with the wire-side terminal completely inserted in the terminal accommodating chamber, thereby holding the wire-side terminal in the insulation housing;

the terminal locking portions include a first group of the terminal locking portions and a second group of the terminal locking portions, the terminal locking portions of the first group being configured to have a higher holding force than each terminal locking portion of the second group; and at least the terminal locking portions in the terminal accommodating chambers located on both outer sides in a maximum diameter direction belong to the first group and at least the terminal locking portions in the terminal accommodating chambers closest to a center of the terminal accommodating chambers belongs to the second group.

2. The connector of claim 1, wherein the terminal accommodating chambers are arrayed to have a rectangular shape, and locking lances in all of the terminal accommodating chambers on both outer sides in a long side direction of the rectangular shape belong to the first group.

3. The connector of claim 2, wherein all of the terminal locking portions in the terminal accommodating chambers located on an outermost periphery, out of the terminal accommodating chambers, belong to the first group.

4. The connector of claim 3, wherein all of the terminal locking portions provided in the terminal accommodating chambers located inwardly of the terminal accommodating chambers on the outermost periphery belong to the second group.

5. The connector of claim 1, wherein each terminal locking portion is a locking lance including a base connected to a housing body of the insulation housing and a tip on a side opposite to the base, and resiliently deformed to deflect and displace the tip in a direction perpendicular to an axial direction of the wire-side terminal, and the locking lance includes a locking portion for engaging and locking the wire-side terminal near the tip and allows insertion of the wire-side terminal into the terminal accommodating chamber by being deflected and displaced and engages the wire-side terminal by resiliently returning when the wire-side terminal is inserted completely in the terminal accommodating chamber, thereby holding the wire-side terminal in the insulation housing.

6. The connector of claim 5, wherein the locking lances belonging to the first group have a higher bending rigidity than the locking lances belonging to the second group.

7. The connector of claim 5, wherein the locking portions of the locking lances belonging to the first group are inserted more into the terminal accommodating chambers than the locking portions of the locking lances belonging to the second group.

* * * * *